US005535847A

United States Patent [19]

DuRapau

[11] Patent Number: 5,535,847

[45] Date of Patent: Jul. 16, 1996

[54] TABLE TOP ATTACHMENT FOR SAWHORSES

[75] Inventor: Kenrick J. DuRapau, Austin, Tex.

[73] Assignee: Storehorse, Inc., San Antonio, Tex.

[21] Appl. No.: 223,987

[22] Filed: Apr. 6, 1994

[51] Int. Cl.[6] ..... E04G 1/00

[52] U.S. Cl. ..... 182/181; 182/153; 108/157

[58] Field of Search ..... 182/153, 181–186, 182/224–227; 108/157, 158

[56] References Cited

U.S. PATENT DOCUMENTS

| | | | |
|---|---|---|---|
| 687,958 | 12/1901 | Fredricks | 108/157 X |
| 714,761 | 12/1902 | Tilley | 182/181 X |
| 2,911,265 | 11/1959 | Hannah | 182/181 |
| 3,930,701 | 1/1976 | Otakie | 108/157 X |

FOREIGN PATENT DOCUMENTS

| | | | |
|---|---|---|---|
| 786497 | 11/1957 | United Kingdom | 108/157 |

*Primary Examiner*—Alvin C. Chin-Shue

*Attorney, Agent, or Firm*—Russell D. Culbertson; Shaffer & Culbertson

[57] ABSTRACT

A table top attachment for a sawhorse includes a table top member and a brace member. The table top member has a planar top surface and a lower surface that includes a series of tab members that snugly mate with the top beam of a sawhorse in an attached position to prevent the table top member from moving laterally with respect to the top beam and allowing the top beam to support the table top member. The brace member is connected at one end to the table top member along one edge of the table top and at an opposite end to one of the sawhorse side supports. When connected to the sawhorse side support the brace cooperates with the sawhorse top beam to support the table top in the attached position.

9 Claims, 3 Drawing Sheets

TABLE TOP ATTACHMENT FOR SAWHORSES

BACKGROUND OF THE INVENTION

This invention relates to work tables or benches and particularly to a table top attachment for a sawhorse. The invention also encompasses a method for supporting a table top on a sawhorse.

Portable work tables and benches have become popular items in recent years for both home and commercial use. These work tables or benches include a sturdy but collapsible support stand and some sort of table top, usually rigidly connected to the supporting frame. Also, other devices such as vices, for example, may be incorporated into the table top or may be attached to the table top. Although popular items, the prior portable work tables or benches were complicated devices, relatively heavy, and fairly expensive.

Aside from portable work tables and benches, the most common type of work stand is a sawhorse. A pair of sawhorses provide a stable support for holding an elongated work piece. Also, sawhorses have a simple and sturdy A-frame construction and are relatively inexpensive. However, a single sawhorse does not provide a table top surface to support a work piece. To provide a table surface, sawhorses must be used in pairs along with a separate board or other rigid and flat piece of material.

SUMMARY OF THE INVENTION

It is a general object of the invention to provide a sawhorse table top attachment that overcomes the above-described problems with prior work stands or work tables. It is also a general object of the invention to provide a method for supporting a table top attachment on a sawhorse.

In order to accomplish these objects, the invention includes a table top attachment that securely but releasably fastens to a sawhorse. Although the invention may be applied to a standard sawhorse having a top beam and two side supports connected together to form an A-frame or A-shape, the invention may be particularly adapted for use with a molded plastic folding sawhorse such as a STORE-HORSE brand folding sawhorse. In either case the table top attachment provides a sturdy table top surface requiring only one sawhorse for support.

The table top attachment according to the invention includes a table member and a rigid brace member connected at a first end to a first edge of the table member. The table member itself includes a planar top surface and a lower surface with top beam connecting means formed on or attached to the lower surface. The top beam connecting means serves to mate with the top beam of the sawhorse to connect the table member to the sawhorse in a proper attached position. When properly connected, the top beam connecting means allows the top beam to support the table member in the proper attached position and prevents the table member from sliding laterally with respect to the sawhorse top beam.

The preferred form of the invention also includes secondary top beam connecting means associated with the edge of the table member opposite the edge to which the brace is connected. The secondary top beam connecting means may connect the table member to the sawhorse top beam in an alternate attached position in which the sawhorse supports the table member at the angle of a drafting or drawing table surface.

The table top attachment according to the invention also includes brace connecting means connected to the brace at the end of the brace opposite the end connected to the table member. The brace connecting means releasably connects the brace member to one of the sawhorse side supports so as to support the table member in the desired attached position.

In the preferred form of the invention, the brace connecting means comprises a plurality of connecting projections spaced apart along a second end of the brace member and adapted to cooperate with openings similarly spaced apart on one of the sawhorse side supports. Each connecting projection includes a base section connected directly to the brace member and a hook section positioned at the distal end of the base section. Both the base and hook sections are adapted to extend through the openings in the sawhorse side supports. However, the hook section is at an angle to its respective base section so that once the base section is inserted and the brace extends at an angle to support the table member, the hook section prevents the projection from being withdrawn from the opening.

The table top attachment according to the invention provides a lightweight and inexpensive attachment to provide a sturdy table or work support on a sawhorse. The single brace member cooperates with the support provided by the sawhorse top beam to securely support the table member in the desired work position. Additionally, with the secondary top beam connecting means, the table top attachment cooperates with the sawhorse to provide a drafting or drawing table surface.

These and other objects, advantages, and features of the invention will be apparent from the following description of the preferred embodiments, considered along with the accompanying drawings.

DESCRIPTION OF THE PREFERRED EMBODIMENTS

Figure 1:
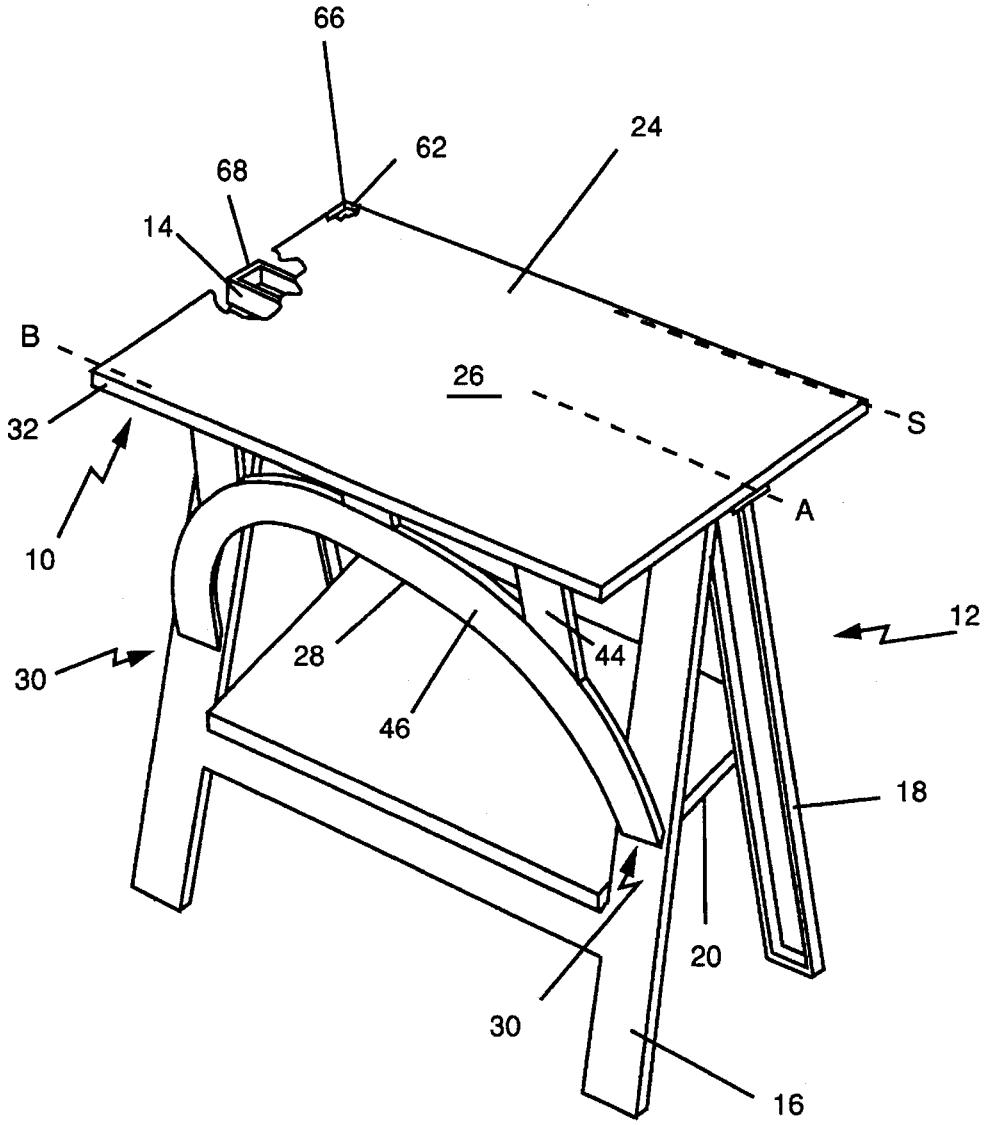
FIG. 1 is an isometric drawing showing a sawhorse table top attachment embodying the principles of the invention connected to a sawhorse in the attached position, and partially cut away to show the top beam of the preferred sawhorse employed with the table top attachment.
Figure 2:
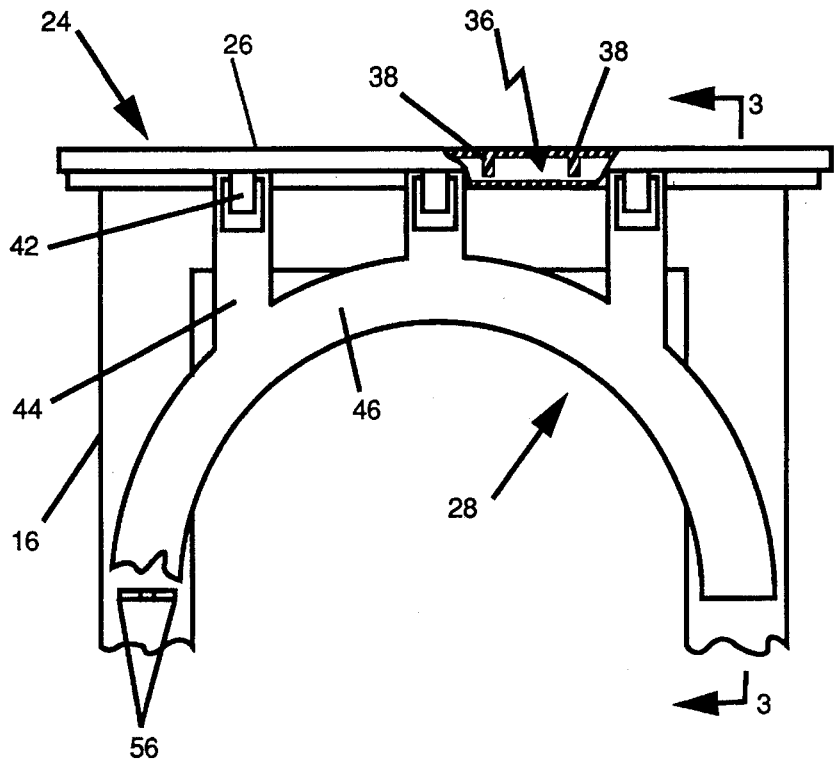
FIG. 2 is a side elevation of the table top attachment and sawhorse in the position shown in FIG. 1, partially broken away to show the top beam connecting means.
Figure 3:
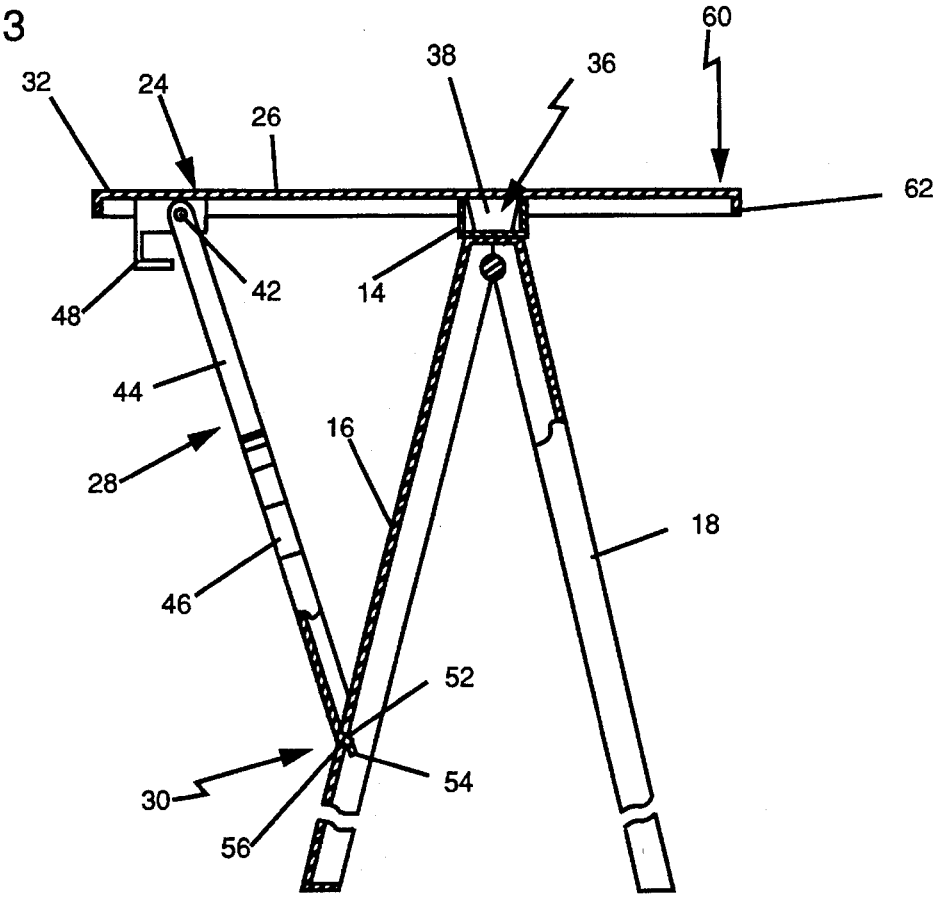
FIG. 3 is a view in partial transverse section taken along line 3—3 in FIG. 3.
Figure 4:
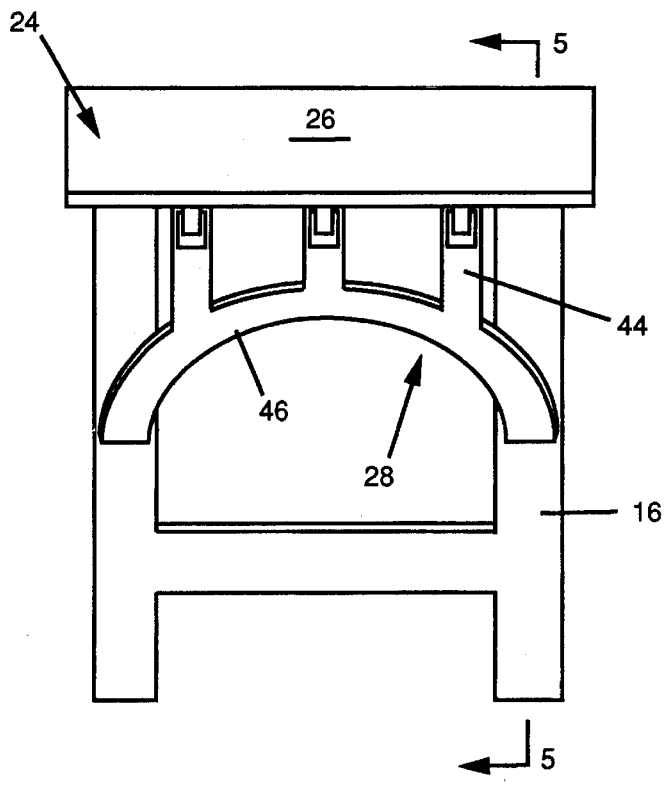
FIG. 4 is a view in side elevation similar to FIG. 2 but showing the table top attachment in the secondary attached position.
Figure 5:
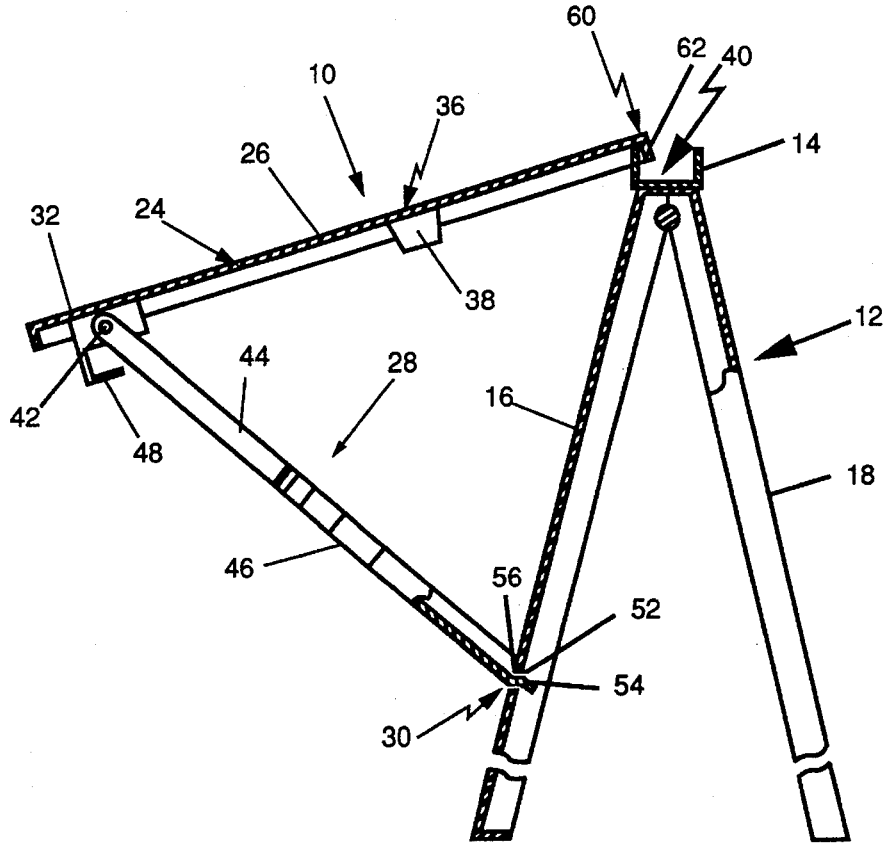
FIG. 5 is a view in partial transverse section taken along line 5—5 in FIG. 4.

FIGS. 1 through 5 show a sawhorse table top attachment 10 embodying the principles of the invention along with a sawhorse 12 with which the attachment is adapted to be used. FIGS. 1 through 3 show the table top attachment 10 in an attached position in which it provides a regular table top surface. FIG. 4 and 5 show the table top attachment 10 connected in a secondary attached position in which it provides a drafting or drawing surface.

As shown in all of the drawings, the table top attachment 10 according to the invention is supported on a sawhorse 12. Although a table top attachment 10 according to the invention may be adapted for use with any sawhorse, including a standard wooden sawhorse, the embodiment shown in the drawings is specifically designed for use with a STORE-HORSE brand folding sawhorse. The sawhorse 12 shown in the drawings includes a top beam 14 which is supported by two side supports 16 and 18 connected together by lateral member 20 to form an A-frame or A-shape. Although the discussion herein will be limited to the specific structure of the folding sawhorse 12 shown in the Figures, those skilled in the art will readily appreciate that a sawhorse table top attachment embodying the principles of the invention may be adapted for use with any sawhorse or other A-frame support.

Referring now to FIGS. 1 through 3, the table top attachment 10 includes a table member 24 having a planar top surface 26. A brace member 28 is connected along one edge of the table top member 24 on a lower surface of the table top member. The end of the brace 28 opposite that which is connected to the lower surface of the table member 24 includes brace connecting means generally shown at reference manual 30 for connecting the brace to one of the sawhorse side supports 16 or 18.

The table member 24 shown is rectangular with the brace 28 connected to the lower surface along a first edge 32 of the rectangular shape. Although the rectangular shaped table member is shown, other shapes could be employed as long as a shape provides a place for connecting to one end of the brace member 28. The lower surface of the table member 24 includes top beam connecting means indicated generally at reference numeral 36 for connecting the table member 24 to the sawhorse top beam 14. In the illustrated form of the invention, the top beam connecting means 36 includes a series of tabs 38 connected to the lower surface of the table member 24 and extending along a primary attachment axis P. The tabs 38 are adapted to fit snugly into a channel 40 (FIG. 1 ) of the sawhorse top beam 14 to hold the table member 24 in the attached position. When in the attached position, the sawhorse top beam 14 supports the table top 24 along the primary attachment axis P and the tabs 38 of the top beam connecting means 36 prevent the table member from moving laterally with respect to the top beam.

The brace member 28 is preferably pivotally attached to the first edge 32 of the table member 24 at hinges 42 that align along a brace axis B. The brace 28 may be any type of brace structure including a continuous planar member or a frame structure. The illustrated form of the brace includes three elongated sections 44 attached to an arch structure 46. The three elongated sections 44 extend to the hinges 42 and the arch ends connect to one of the side supports 16 or 18, side support 16 in the drawings. The pivot connection on hinges 42 allows the brace 28 to pivot between a position in which it lies approximately parallel to the table top and a position in which it extends at a substantial angle to the table top. Hooks 48 are preferably formed on the table member 24 to hook on the sawhorse for storage when the brace 28 is folded up adjacent to the table top.

Regardless of the brace structure, the brace 28 includes connecting means 30 for connecting the end of the brace opposite the end connected to the table top member 24 to one of the sawhorse side supports 16 or 18. Preferably, the brace connecting means 30 comprises a series of connecting projections spaced apart along the end of the brace opposite that connected to the table member 24, in this case, the ends of the arch 46. Each projection of the connecting means 30 includes a base section 52 and a hook section 54. Each base section 52 extends from the brace 28, and the respective hook section 54 extends further from the distal end of the base section. The projections each cooperate with an opening 56 through the side support 16 to connect the brace 28 to the side support.

To make the connection, both sections 52 and 54 of each projection are extended through their respective opening 56 in the side support 16. When the brace 28 is then moved to the angle to support the table top 24 in one of the attached positions, the hook section 54 of each projection catches on one side of the side support opening 56 to prevent the projection from being withdrawn from the opening. Thus, the brace connection allows the brace 28 to take loads both in compression and tension to support the table member 24 in the desired attached position.

Referring now to FIGS. 4 and 5, the table top attachment 10 is shown connected in a secondary attached position to provide a drafting or drawing surface. In this form of the invention the table member 24 includes secondary top beam connecting means shown generally at reference number 60. The preferred secondary top beam connecting means 60 includes a rim 62 on the edge of the table member 24 opposite that to which the brace 28 is connected. The rim 62 defines a secondary connecting axis S and hooks on one side of the sawhorse top beam channel 40 to support the table member 24 in the secondary attached position. Slots 66 (FIG. 1 ) in the rim 62 allow the rim to fit over the ends 68 (FIG. 1) of the top beam channel 40. In this secondary attached position the brace 28 supports the other edge of the table top in the same way as in the primary attached position with the projections of the connecting means 30 on the brace member connecting the brace to the side support 16.

To connect the table top attachment 10 in the attached position shown in FIGS. 1 through 3, the brace 28 is first pivoted down away from the plane of the table top. With the brace 28 pivoted downwardly, the method includes aligning the projections of the connecting means 30 with their respective openings 56 in the side support 16 to which the brace is to be connected and inserting both the hook section 54 and base section 52 of each of the projections until the end of the brace 28 rests against the side support 16. At this point, the method continues with the step of pivoting the brace 28 upwardly about the projections connected to the side support 16 and inserting the tabs 38 of the table top connecting means 36 into the sawhorse top beam channel 40. When the tabs 38 are properly inserted, the angle of the brace 28 to the side support 16 allows the hook section 54 of each connecting projection to catch on the opening 56 and prevent the projection from being withdrawn from the opening. Thus the brace 28 in this position is capable of taking loads in compression and tension to support whatever load is on the table member 24.

Connecting the table top attachment 10 in the secondary attached position requires the same steps as connecting the table top in the primary attached position except rather than placing the tabs 38 in the channel 40, the method includes hooking the table member rim 62 over one edge of the top beam channel 40 as shown in FIG. 5. At this resulting brace angle, the hook section 54 of each connecting projection still prevents the projection from being withdrawn from its respective side support opening 56.

The above described preferred embodiments are intended to illustrate the principles of the invention, but not to limit the scope of the invention. Various other embodiments and modifications to these preferred embodiments may be made by those skilled in the art without departing from the scope of the following claims.

I claim:

1. A method of supporting a table top attachment on a sawhorse that includes a top beam and two side supports connected to the top beam to form an A-shaped structure with the top beam at the top of the A-shape and the two side supports forming the two sides of the A-shape, the table top attachment comprising a table top member having a width greater than the width of the sawhorse top beam and a rigid brace member pivotally connected thereto along a brace axis at one edge of the table top member, the method comprising the steps of:

(a) inserting a plurality of hook projections each through a separate opening spaced apart on one of the sawhorse side supports each hook projection being connected to a distal end of the brace member;

(b) moving the brace member to form an angle with said sawhorse side support at which the hook projections catch on the respective sawhorse side support opening to prevent such hook projection from being withdrawn from said opening;

(c) supporting the table top member in an attached position with the sawhorse top beam, the sawhorse top beam extending along an attachment axis of the table top member when supporting the table top member in the attached position and contacting at least one lateral support member extending from the table top member; and (d) restraining the table top member from moving laterally with respect to the sawhorse top beam by contact between the sawhorse top beam and the lateral support member.

2. A sawhorse and detachable table top attachment comprising:

(a) a sawhorse having a top beam and two side supports connected to the top beam to form an A-shaped structure, with the top beam at the top of the A-shape and the two side supports forming the two sides of the A-shape, a first one of the two side supports including two spaced apart side support openings;

(b) a table top member having a planar table top surface and a lower surface opposite the table top surface;

(c) top beam connecting means positioned on the lower surface of the table top member and extending along an attachment axis for releasably connecting the table top member to the sawhorse top beam in an attached position in which the table top member is supported by the sawhorse top beam along the attachment axis and is restrained from moving laterally with respect to the sawhorse top beam;

(d) a rigid brace member connected at a first end thereof to a first edge of the table top member along a brace axis that extends generally parallel to the attachment axis of the sawhorse top beam connecting means; and (e) a connecting projection for each side support opening, each connecting projection including, (i) a base section connected to the brace member and adapted to fit through one of the side support openings to an inserted position when the brace member is at a first angle with respect to the first side support, and (ii) a hook section connected to a distal end of the base section and also adapted to fit through said one of the side support openings, but only when the brace member is not at the first angle to the first side support.

3. The table top attachment of claim 2 wherein the first angle is an angle at which the brace member extends to the first side support member to support the table top member in the attached position.

4. The table top attachment of claim 2 further comprising:

(a) secondary top beam connecting means connected to an edge of the table top member opposite the first edge thereof and extending along a secondary connection axis that is parallel to the attachment axis, the secondary top beam connecting means for connecting the table top member to the sawhorse top beam in a secondary attached position in which the connecting projections connect the brace member to the first side support so as to enable the brace member to support the table top member.

5. The table top attachment of claim 2 wherein the brace member is pivotally connected to the table top member along the brace axis and is capable of pivoting about the brace axis to a position in which the brace member lies substantially parallel to the plane of the table top surface.

6. The table top attachment of claim 2 further including:

(a) a plurality of storage connectors attached to the lower surface of the table top member for connecting the table top member to the sawhorse for storage.

7. A table top attachment for a sawhorse that includes a top beam and two side supports connected to the top beam to form an A-shaped structure with the top beam at the top of the A-shape and the two side supports forming the two sides of the A-shape, a first one of the side supports including two side support openings at spaced apart locations, the table top attachment comprising:

(a) a table top member having a planar table top surface and a lower surface opposite the table top surface;

(b) top beam connecting means positioned on the lower surface of the table top member and extending along an attachment axis for releasably connecting the table top member to the sawhorse top beam in an attached position in which the table top member is supported by the sawhorse top beam along the attachment axis and is restrained from moving laterally with respect to the sawhorse top beam;

(c) a rigid brace member connected at a first end thereof to a first edge of the table top member along a brace axis extending generally parallel to the attachment axis of the sawhorse top beam connecting means; and (d) a connecting projection for each side support opening, each connecting projection including, (i) a base section connected to the brace member and adapted to fit through one of the side support openings to an inserted position when the brace member is at a first angle with respect to the first side support, and (ii) a hook section connected to a distal end of the base section and also adapted to fit through said one of the side support openings but only when the brace member is not at the first angle to the first side support.

8. The table top attachment of claim 7 wherein the first angle is an angle at which the brace member extends from the table top member to the side support member to support the table top member in the attached position.

9. The table top attachment of claim 7 further comprising:

(a) secondary top beam connecting means connected to an edge of the table top member opposite the first edge thereof and extending along a secondary connection axis that is parallel to the attachment axis, the secondary top beam connecting means for connecting the table top member to the sawhorse top beam in a secondary attached position in which the connecting projections connect the brace member to the first side support so as to enable the brace member to support the table top member in the secondary attached position.

* * * * *